US010329830B2

(12) United States Patent
Peck et al.

(10) Patent No.: US 10,329,830 B2
(45) Date of Patent: Jun. 25, 2019

(54) PORTABLE SECURITY BOX WITH A SOLAR PANEL AND IMPROVED LOCK THAT ATTACHES TO A FIXED OBJECT TO SECURE VALUABLES

(71) Applicants: Robert Michael Peck, Gansevoort, NY (US); Jonathan Bradley Kinas, Aventura, FL (US); Avin Samtani, Miami Beach, FL (US)

(72) Inventors: Robert Michael Peck, Gansevoort, NY (US); Jonathan Bradley Kinas, Aventura, FL (US); Avin Samtani, Miami Beach, FL (US)

( * ) Notice: Subject to any disclaimer, the term of this patent is extended or adjusted under 35 U.S.C. 154(b) by 0 days.

(21) Appl. No.: 14/685,729

(22) Filed: Apr. 14, 2015

(65) Prior Publication Data

US 2017/0254137 A1 Sep. 7, 2017

Related U.S. Application Data

(63) Continuation-in-part of application No. 14/253,338, filed on Apr. 15, 2014, and a continuation-in-part of (Continued)

(51) Int. Cl.
*E05G 1/00* (2006.01)
*A47C 7/62* (2006.01)
(Continued)

(52) U.S. Cl.
CPC ..... *E05G 1/005* (2013.01); *A47C 1/14* (2013.01); *A47C 7/62* (2013.01); *E05B 15/00* (2013.01);
(Continued)

(58) Field of Classification Search
CPC E05G 1/005; E05G 1/04; E05G 1/026; E05G 1/00; E05G 1/02; E05G 1/024;
(Continued)

(56) References Cited

U.S. PATENT DOCUMENTS 1,404,263 A * 1/1922 Bludworth ..... F01P 11/0214 220/DIG. 32
2,755,748 A 7/1956 Abell
(Continued)

*Primary Examiner* — Lloyd A Gall

(57) ABSTRACT

A portable, universally fitting, stylish, lockable security box that integrally affixes to an object such as the support or cross bar on a frame of a beach lounge chair, a stroller, bike or similar member where it is desirable to protect your valuables on a stationary or a larger movable object. The security box is a device preferably comprised of a main top component having a solar panel thereon and a main bottom component which are hinged together and able to be securely closed by a RFID locking mechanism. When the security box is positioned over an elongate object, such as the support bar of a chair, stroller or other object, the security box can be affixed to the elongate object by employing an integral hasp or integral locking mechanism to close the security box around the support object, such that the support object extends through the security box by passing through specially configured openings in the security box.

19 Claims, 11 Drawing Sheets

Related U.S. Application Data application No. 13/413,017, filed on Mar. 6, 2012, now abandoned.

(60) Provisional application No. 61/981,656, filed on Apr. 18, 2014.

(51) Int. Cl.

| | |
|---|---|
| ***E05G 1/04*** | (2006.01) |
| ***E05B 39/04*** | (2006.01) |
| ***E05B 65/00*** | (2006.01) |
| ***E05B 15/00*** | (2006.01) |
| ***A47C 1/14*** | (2006.01) |

(52) U.S. Cl.

CPC ..... *E05B 39/04* (2013.01); *E05B 65/0075* (2013.01); *E05G 1/04* (2013.01)

(58) Field of Classification Search

CPC . E05G 2700/00; E05G 2700/02; E05B 15/00; E05B 65/0075; E05B 39/04; E05Y 2800/17; A47C 1/14; A47C 7/62; A45C 1/12

USPC ..... 70/58, 63, 261, 158–162, 163–173, 18, 70/19, 177, 178, 180; 109/50–52, 58, 109/58.5, 59 R, 59 T, 64, 78; 248/551–553; 297/188.18, 188.19, 188.2, 297/188.13, 188.14, 188.01, 188.15, 297/188.21; 220/475, 480–483, 676; 5/931; 108/26, 28, 29; 232/4 R; 446/8

See application file for complete search history.

(56) References Cited

U.S. PATENT DOCUMENTS

| | | | | |
|---|---|---|---|---|
| 4,061,395 | A | 12/1977 | Boole | |
| 4,435,966 | A * | 3/1984 | Craig | E05B 65/5276 220/210 |
| 4,573,332 | A | 3/1986 | Ma | |
| 4,667,491 | A | 5/1987 | Lokken et al. | |
| 4,971,390 | A | 11/1990 | McGinley | |
| 5,531,082 | A | 7/1996 | Wolk et al. | |
| 6,085,671 | A | 7/2000 | Kerr et al. | |
| 6,876,756 | B1 * | 4/2005 | Vieweg | F41C 33/0227 361/206 |
| 7,305,858 | B1 | 12/2007 | Wu | |
| 7,607,933 | B2 | 10/2009 | Shai et al. | |
| 7,641,279 | B1 | 1/2010 | Curcio | |
| 8,201,506 | B1 * | 6/2012 | Parlapiano | E05G 1/005 109/50 |
| 8,789,884 | B1 | 7/2014 | Edelman et al. | |
| 9,039,077 | B1 * | 5/2015 | Santamaria | A47C 7/72 297/31 |
| 9,390,571 | B1 * | 7/2016 | Kupfer | A47C 7/72 |
| 2005/0199019 | A1 * | 9/2005 | Marcelle | E05B 47/0012 70/38 A |
| 2012/0222589 | A1 * | 9/2012 | Miyashita | E05G 1/005 109/40 |
| 2012/0298018 | A1 * | 11/2012 | McCabe | A45C 13/20 109/51 |
| 2012/0305414 | A1 * | 12/2012 | Magnus | F25D 23/12 206/216 |
| 2014/0041558 | A1 * | 2/2014 | Lubotta | E05G 1/08 109/38 |
| 2014/0366784 | A1 * | 12/2014 | Berger | E05G 1/005 109/23 |
| 2015/0000571 | A1 * | 1/2015 | Stemen | E05G 1/005 109/23 |

* cited by examiner

PORTABLE SECURITY BOX WITH A SOLAR PANEL AND IMPROVED LOCK THAT ATTACHES TO A FIXED OBJECT TO SECURE VALUABLES

PRIORITY CLAIM

The present application is a continuation-in-part application of Application No. 61/981,656 filed on Apr. 18, 2014 and application Ser. No. 14/253,338 filed on Apr. 15, 2014 which is a continuation-in-part application of application Ser. No. 13/413,017 filed on Mar. 6, 2012, now abandoned.

DESCRIPTION OF PRIOR ART

In general, examples of the concept of having a lock box that attaches to a fixed object are known. The following patents and Patent applications are illustrative of the known prior art in this area.

U.S. Pat. No. 4,061,395 issued to Boole in 1977 for "Portable Drawer Assembly".

U.S. Pat. No. 7,305,858 issued to Wu in 2007 for "Security box"

U.S. Pat. No. 4,573,332 issued to Ma in 1986 for "Portable Security box"

U.S. Pat. No. 7,607,933 issued to Shai in 2009 for "Portable tool box locker"

U.S. Pat. No. 6,085,671 issued to Kerr in 2000 for "Lock box"

U.S. Pat. No. 5,531,082 issued to Wolk in 1996 for "Portable Security Case"

U.S. Pat. No. 4,971,390 issued to McGinley in 1990 for "Safety Locker Drawer for use with a chair"

U.S. Pat. No. 4,667,491 issued to Lokken in 1987 for "Portable Travel Safe"

U.S. Pat. No. 7,641,279 issued to Curcio in 2010 for "Storage Compartment for a Chair"

BACKGROUND OF THE INVENTION

This invention relates to a self-contained safe, lockable container, or lock box for securing valuables and more particularly to a portable, lockable security box that may be secured to a fixed object. It has long been known that when people are at a place of relaxation or recreation (beach, pool, camp, park, or other outdoor activity) people are concerned that their valuables are safe and secure. This invention is a simple way to secure valuables to a fixed object in a stylish, universal fit, with a specially designed lockable container. This invention will greatly reduce the worry a person has concerning the security of their valuables when they use the invention, such as when they go for a swim, wherein previously one would hide objects in sneakers or under a towel.

The present invention relates to a portable, lockable security box such as a security box, self-contained safe, lockable container, portable security safe or similar device. The above examples are all similar in concept but lack the simplicity and features which are important elements which the present invention provides. Cable locks, Sliding trays, complex mounting mechanisms, multiple component assemblies, and materials subject to degradation are all embodied in the prior innovations. The present invention utilizes innovative features to solve the prior problems by providing a novel solution.

The traditional safe is used to store objects in such a way as to restrict access to these objects. Typically, safes are meant to be permanent objects which are highly impregnable except to users with access to the safe's inner contents by way of a key or knowledge of a combination. However, in order to keep the safe, and its contents, from being easily removed, traditional safes have been intentionally designed to be heavy, bulky, and difficult to move. In certain instances, individuals may desire to restrict access to objects, such as their wallet, keys, phone, firearm, or other items, while they are somewhere in which it would be impractical to bring a traditional safe. Thus, one may desire to have a portable safe to store valuables while temporarily out of view of the valuables, such as when swimming, enjoying recreational activities, or relaxing on beach or pool lounge chairs. However, because it would be undesirable for the portable safe to be portable while the user is using the safe to restrict access to the safe's contents, it is also desirable to provide a lockable storage container that is self-contained and removably attachable to a variety of other fixed or secure elements such as patio chairs, strollers, bikes or structural members. People commonly carry valuables such as cell phones, watches, wallets, glasses, room keys, etc. with them. When a person decides to do an activity where it is not convenient or where they cannot take all of their valuables with them, the person must decide what to do to make sure their valuables are not stolen when they are temporarily out of view of them. Prior to this invention, one had to use a complex lock box with a chain or mounting brackets to store their valuables. Alternatively, locking boxes were placed on door knobs or were limited to use on the non-supporting areas of a specific type of chair, but did not have the flexibility to be secured to any desirable elongate object nor the space to store valuables from multiple people. Prior to this invention, there was no safe capable of true portability combined with the ability to attach to structural elements in a truly removable fashion. Without a portable safe, the only option is to hide valuables out of sight, such as under a towel, and hope the valuables are there when one returns. Despite market demand, prior attempts to address this problem have fallen short as a result of a failure to address the problem in the novel manner disclosed herein. A simplified design of the type disclosed herein with innovative features exemplifies an invention that has been desired in the marketplace and is more fully described herein.

In addition to the foregoing, the improved invention disclosed herein preferably includes a solar panel to allow the user to charge their electronics while they are securely stored in the lockable container. Additionally, an improved locking mechanism that utilizes existing RFID technology is disclosed herein such that the present invention is particularly desirable for use at public or hotel pools wherein the user may use a hotel card or wrist band with RFID technology to open or close the lockable container.

SUMMARY OF THE INVENTION

The portable, lockable security box of the present invention is specifically designed to store valuables at a variety of locations, such as the beach, pool or other recreation area. The unique, one of a kind security box of the present invention self-fastens to an elongate object, including a support member such as on a lounge chair or stroller, a boat or golf cart safety rail, a secured rope, or even a bicycle frame. The security box opens up and closes over a bar of a lounge chair frame, stroller or other support element and can then be securely locked. In order to accommodate a variety of support element shapes or sizes, the security box ingeniously includes a versatile support cavity.

The support cavity is made up of an arcuate portion, a corner lip, and a straight portion on each of two side openings in the security box. In an example of one generally preferred form of the invention, the support cavity fits on a wide variety of support elements, such as a square support with a diameter approximately 1.5 inches square or a round bar with a diameter of approximately 1.5 inches or less, such as lounge chair support bar frames or stroller frame. This unique security box is self-contained and completely portable. Unlike prior attempts to solve the problem addressed by the present invention, this security box does not require permanent fixation to the support element, such as being bolted on or screwed down, and does not require assembly, such as the insertion of a pivotable arm or a pawl. The present invention is ideal for use at the beach, park or pool, wherein the security box can be filled with any valuables of allowable size that the owner would like to secure, enclosed over any elongate object that is part of the lounge chair, stroller or structural member and then locked using the locking mechanism that comes with the lockable security box (ex. Integral Briefcase Lock) or external padlock. In an alternate embodiment of the present invention, the locking mechanism consists of an RFID arrangement where the owner is able to activate the lock by using a RFID chip on a bracelet or a key type card to activate an RFID powered switch on the lockable container.

The present invention is designed to provide a level of security at the beach, park, or pool so that the owner can leave the stored items unattended and not have to worry about them as they would if the same items were left out in the open. This security box is a theft deterrent device which, if used properly, should decrease the probability that valuables are stolen at the beach, park or pool. It is submitted that a potential thief is less likely to attempt to break open the present invention and potentially draw attention to themselves rather than quickly search unattended towels and shoes that are likely hiding places for valuables. Additionally, the nature of the materials of the present invention do not allow the thief to see what, if anything is located in the portable, lockable security box, thereby further reducing the likelihood that a thief will target the lockable security box rather than searching for easier targets.

In a preferred form of the present invention, the security box is specifically designed to be temporarily affixed to lounge chairs by use of integral side openings which surround the elongate support bar on the back of a lawn or beach chair. Placing the security box on the back of a chair, wherein it would not be easily visible from the front of the chair, has aesthetic utility as well as providing an additional level of security due to the decreased visibility, especially if the chair were situated against a wall or sand dune. Furthermore, the exterior shape of the lock box is generally a 3D ellipse, ovoid or bulbous shaped and has multiple rounded edges so as to not interfere with the operation of the device to which it is attached while maximizing the internal storage space. Furthermore, the top and bottom components are designed to close flush with each other, as opposed to one being larger than the other, which decreases the likelihood of a snag or injury by the user of the security box. The support cavity is configured with two versatile side openings to engage a variety of cross-sectional shapes of elongate support members to which it can attach. As described more fully below, the security box preferably includes a greater length between the side openings of the support cavity than the front to back dimension.

The present invention relates generally to a simplified, portable, universally fit, lockable container that attaches to a fixed object to store valuables that includes a top component that connects to the bottom component by means of a hinge which has a built in support cavity that will fit a variety of different sized fixed objects such as the metal frame supports of a beach lounge chairs with an integral compartment that will store valuables such as cell phones, wallets, watches, glasses, room keys, and other valuables which is secured by an integrated locking system under which the fixed object is also clasped. The locking system may include a hook type member that is retained in an opposite recess wherein the movement of the hook type member is actuated by a combination lock or an RFID system which will prevent unauthorized entry to the lockable container while the user is swimming or enjoying recreational activities.

A further improvement for the present invention includes a solar panel on the top surface of the lockable container to allow the user to charge their cellphone or other electronic device while it is stored in the lockable container. In one form of this improvement, the solar panel is affixed in a recessed cavity on the top surface of the lockable container. The charging cord extends into the interior of the lockable container through the side opening or more preferably may extend down through the recessed area to the interior surface of the lockable container. The user may then connect their cellphone or other electronic device to the universal connector on the cord and their electronic device will charge while it is securely located in the lockable container. The solar panel of this embodiment provides additional charging power for the user's electronic devices to enable the user to apply an additional charge their electronic device during a day at the beach or pool such that the user does not need to be concerned that the charge in their electronic device will run down before the day is over.

DETAILED DESCRIPTION OF THE DRAWINGS

Figure 1:
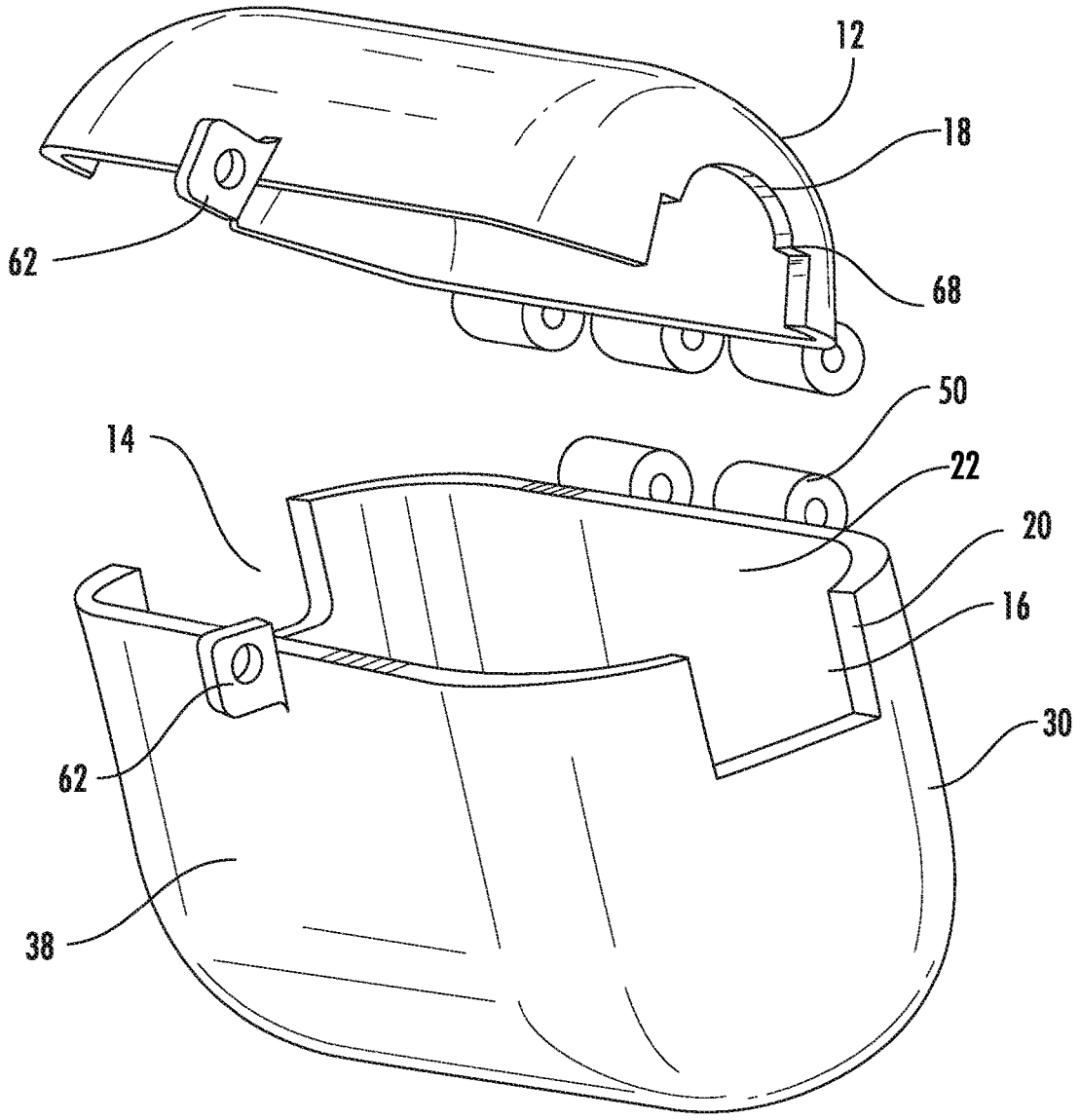
FIG. 1 illustrates an exploded perspective front view of the two main components of the security box and the side openings.
Figure 2:
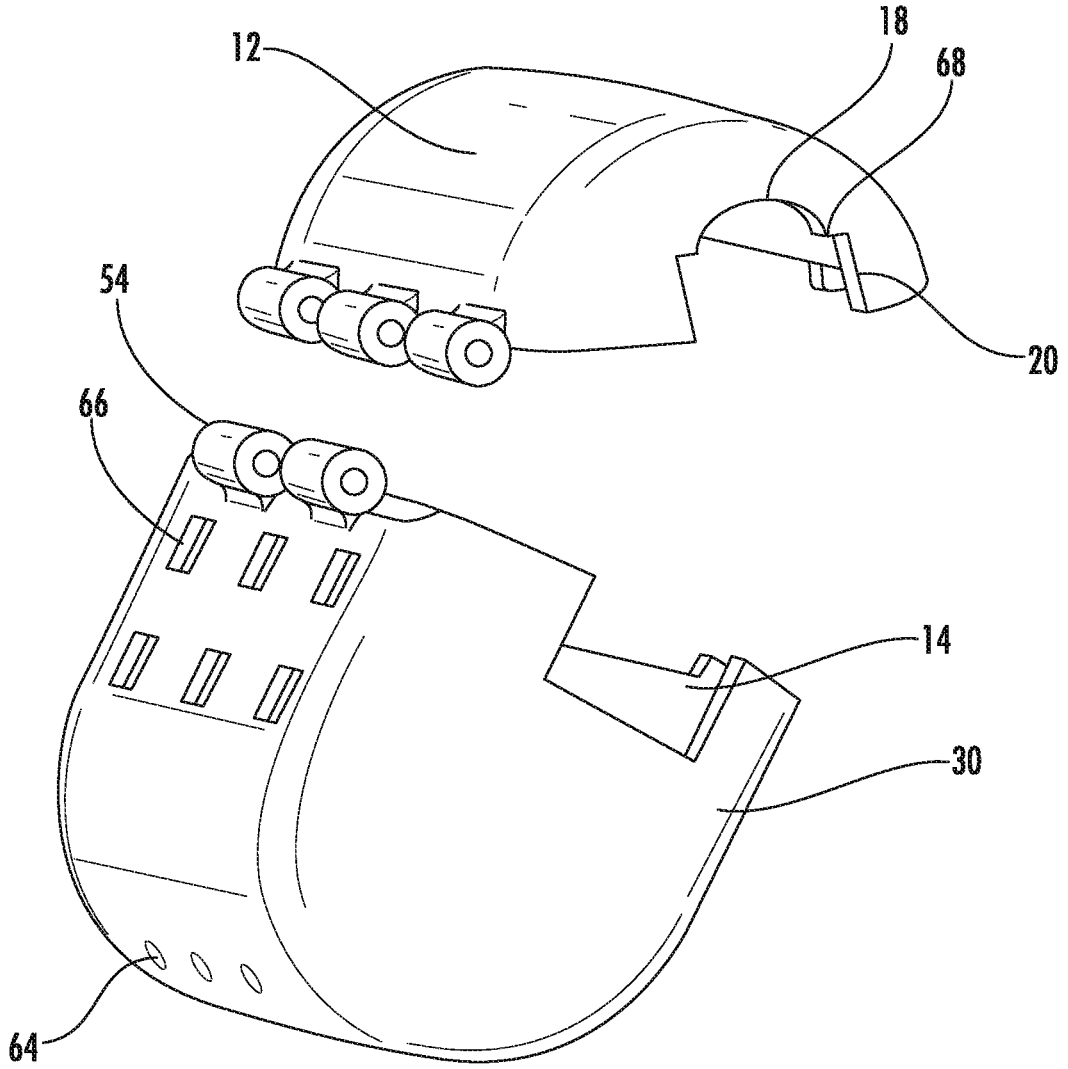
FIG. 2 illustrates an exploded perspective view from the back of the two main components of the security box and the side openings.
Figure 3:
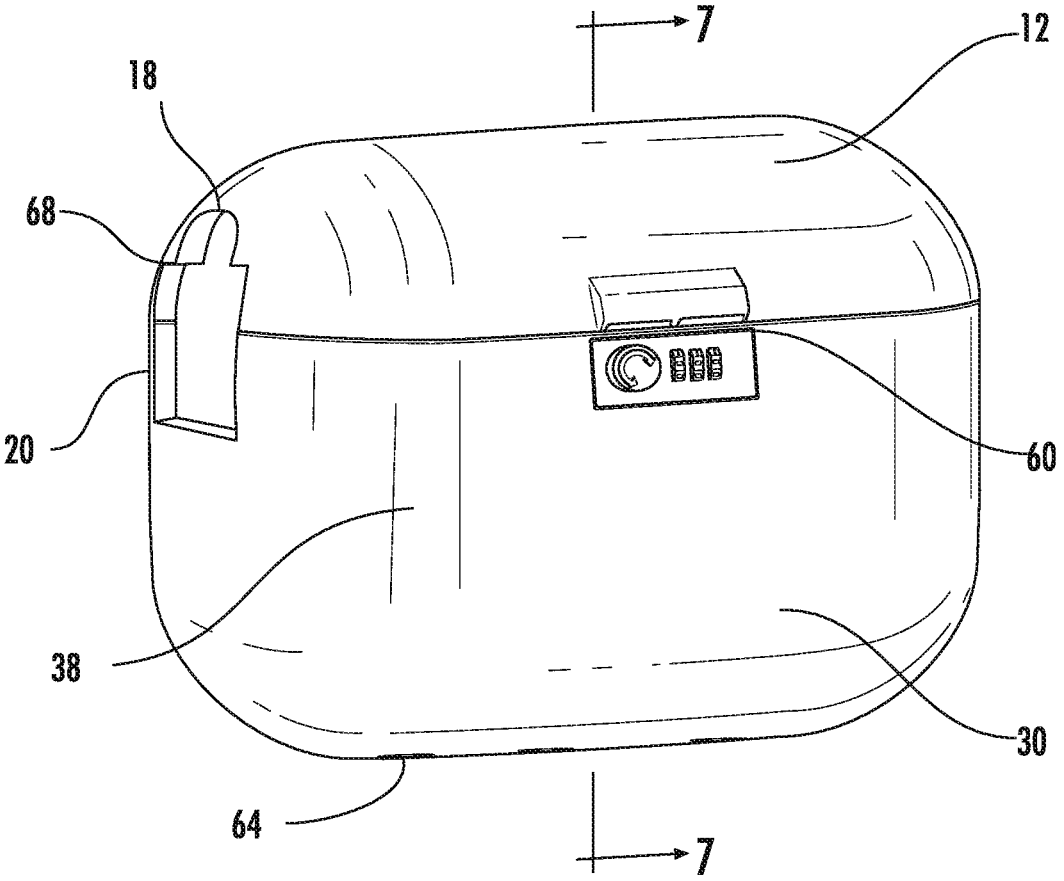
FIG. 3 shows a front view of both main components when assembled.
Figure 4:
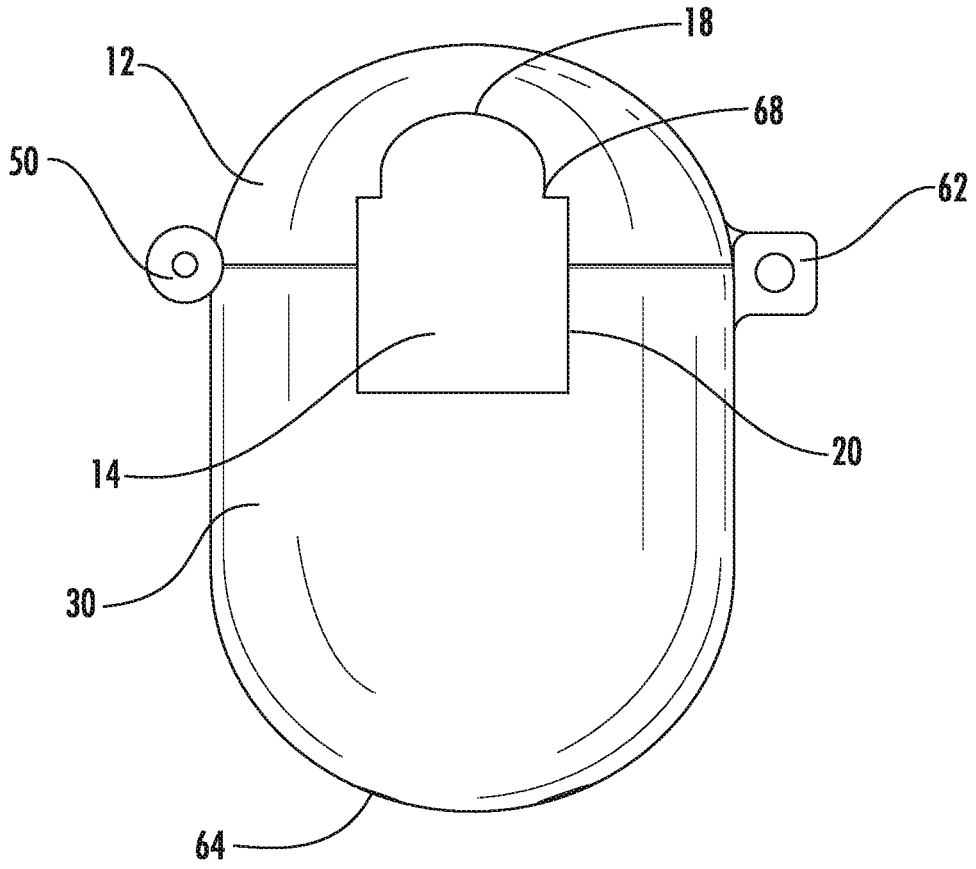
FIG. 4 shows a side view of both main components when assembled.
Figure 5:
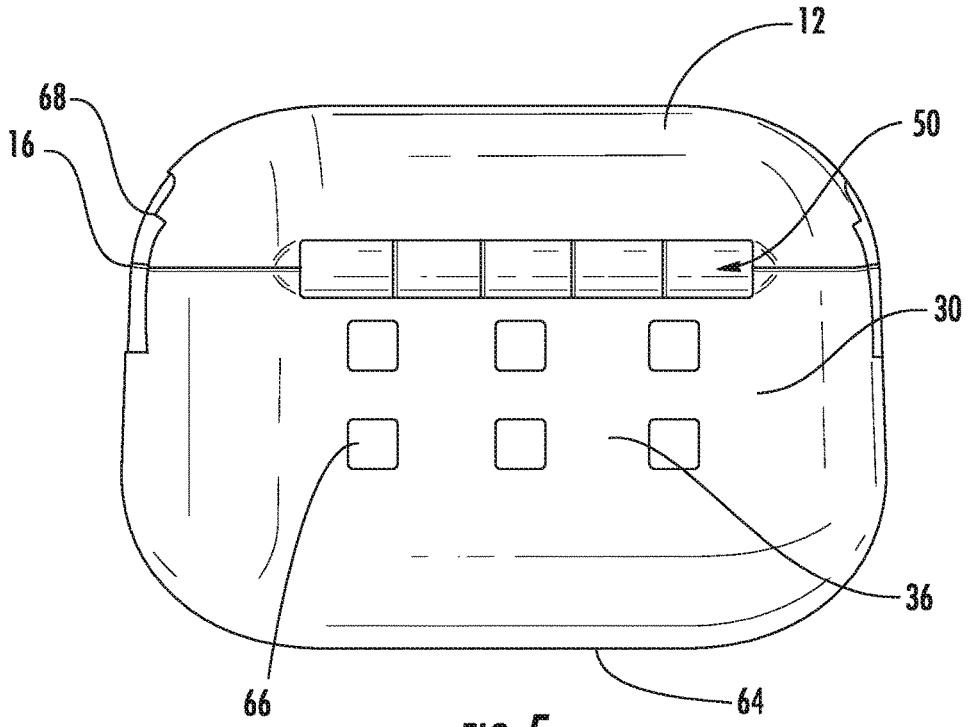
FIG. 5 shows a rear view of both main components when assembled.

As shown in FIGS. 1 and 2 the security box 10 of the present invention has a top component 12 which connects to the bottom component 30 through an integrally attached hinge 50. The hinge 50 operates by tapping a tapered pin 52 into each side of the hinge extensions 54. The top component 12 is hinged and movable relative to the bottom component 30 to close the top component 12 onto the top of the bottom component 30. As shown in FIG. 1, the hasps 62 of the locking mechanism 60 come together so they may be locked with a padlock to secure the user's valuables inside. Alternately, as shown in FIGS. 3 and 7, the lockable security box 10 may have a self-contained locking mechanism 60, such as an integral briefcase style locking mechanism as described more fully below.

As best shown in FIGS. 1, 2, 4 and 7, the top component 12 includes opposed side openings 14 and 16. In a preferred form of the present invention, the side openings 14 and 16 are formed by the combination of the upper arcuate portion 18, corner lip 68, straight side portions 20 of the top component 12 and the generally straight sides and generally rectangular shape of the side openings 14 and 16 of the bottom component 30. The combination of the arcuate portion 18, the corner lip 68, and the straight side portions 20 allows the side openings 14 and 16 to engage a variety of cross sectional shapes of elongate support bars. When the support bar has a circular cross section, the support bar will typically contact the upper arcuate portion 18 of the side openings 14 and 16. When the support bar has a rectangular, oval or other shaped cross section, the support bar will contact either the corner lip 68 or both the upper arcuate portion 18 and the corner lip 68 of the side openings 14 and 16 to reduce the movement of the lockable security box 10 relative to the support bar when the lockable security box 10 encloses the support bar. In this configuration, the security box cannot be removed from the support bar without cutting through the support bar or breaking the hinge or locking mechanisms of the present invention.

Figure 7:
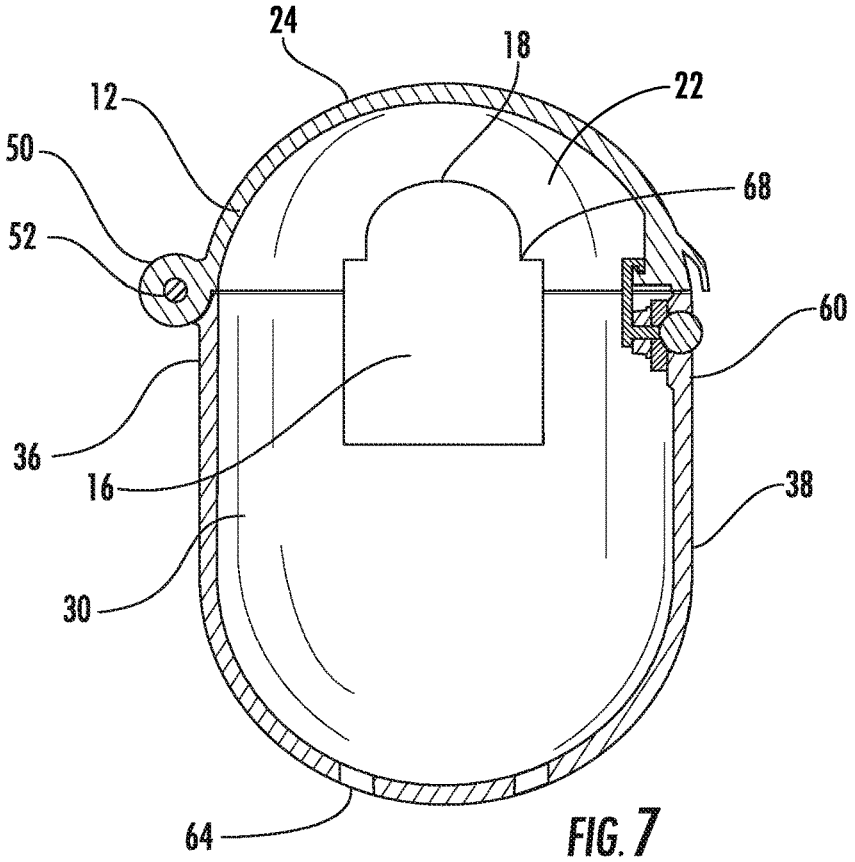
FIG. 7 shows a cross sectional view of a security box taken generally along the plane generally bisecting the embodiment of the invention shown in FIG. 3.

As shown in FIGS. 1, 2 and 7, the top component 12 includes an inner surface 22 and an outer surface 24. In a preferred form of the present invention, the inner surface and the outer surface of the top component 12 are preferably of general uniform thickness, although, it is anticipated that the thickness may vary to reinforce certain sections of the top component or to accommodate various manufacturing processes. The top component is preferably manufactured of an ABS material, although a variety of other strong and durable materials such as Poly Carbonates, nylon composites, carbon fibers or certain other high strength materials may be used to provide the attributes desired in the present invention. As shown in FIGS. 1, 2 and 7, the top component has a generally elongate lengthwise dimension between the side openings 14 and 16 and is generally u-shaped in cross sectional shape between the front surface 26 and back surface 28 of the top component. The height of the top component is generally chosen to be sufficient to accommodate the majority of cross sectional sizes of intended support bars in the side openings 14 and 16, while providing sufficient structural integrity around the support bar S and in combination with the bottom component 30 to provide secure engagement with the support bar. The back surface 28 of the top component 12 preferably includes a plurality of outwardly extending hinge extensions 54 having circular openings there through to securely retain the tapered pins 52 therein when the lockable security box is assembled. The front surface 26 of the top component 12 includes at least a portion of the locking mechanism 60 thereon. A shown in FIG. 1, a hasp member 62 forms an extension that projects forwardly from the front surface 26 of the top component 12 in a manner to allow the side by side positioning of the hasp 62 from the bottom component 30 to allow the insertion of a portion of a lock through each of the hasps to securely close the lockable security box 10. As also described in the application and as shown in FIG. 7, the locking mechanism may also consist of a self-contained lock similar to the types of locks used for bicycles, storage units or similar devices. In this form of the locking mechanism 60, a combination lock type feature extends or retracts to engage a hasp member 62 that is in a recessed portion located along the inner surface 22 of the top component 12.

As shown in FIGS. 1, 2 and 7, the bottom component 30 includes an inner surface 32 and an outer surface 34. In a preferred form of the present invention, the inner surface and the outer surface of the bottom component 30 are preferably of generally uniform thickness, although, it is anticipated that the thickness may vary to reinforce certain sections of the bottom component or to accommodate various manufacturing processes or even to provide an internal support surface for the valuables of the user. The bottom component 30 is preferably manufactured of an ABS material, although a variety of other strong and durable materials such as Poly Carbonates, nylon composites, carbon fibers or certain other high strength materials may be used to provide the attributes desired in the present invention. As shown, the bottom component 30 has a generally elongate lengthwise dimension between the side openings 14 and 16 and is generally ovoid, elliptical or u-shaped in cross sectional shape between the back surface 36 and front surface 38 of the bottom component 30. In the preferred form of the present invention, the inner surface 32 of the bottom component preferably forms a recessed area that has sufficient size to retain the valuables from multiple people. The height of the bottom component 30 is generally chosen to provide sufficient interior volume to accommodate the majority of the valuables typically carried by beach, park or pool goers. As with the top component 12, the bottom component 30 preferably includes a greater lengthwise dimension than the width dimension to provide a bottom component which extends along the lengthwise dimension of an elongate support bar. The bottom component 30 includes the bottom portions of the side openings 14 and 16. In the preferred form of the side openings 14 and 16, the shape on the bottom component is preferably rectangular to accommodate a variety of sizes of cross sectional shapes of the typical elongate support bar while providing sufficient structural integrity around the support bar and in combination with the top component 12 to provide secure engagement with the support bar. The back surface 36 of the bottom component 30 preferably includes a plurality of outwardly extending hinge extensions 54 having circular openings there through to securely retain the tapered pins 52 therein when the lockable security box 10 is assembled. As further shown in FIG. 2, the bottom surface of the bottom component 30 may include a plurality of drainage holes 64 to allow for drainage if the interior compartment of the lockable security box 10 gets wet. FIG. 2 also shows the back surface 36 of the bottom component as including a plurality of square box shaped openings 66 which are carved out and can be punched through to create a place where fasteners may be affixed if deemed necessary by a consumer.

The front surface 38 of the bottom component 30 includes at least a portion of the locking mechanism 60 thereon. As shown in FIG. 1, a hasp member 62 forms an extension that projects forwardly from the front surface 38 of the bottom component 30 in a manner to allow the side by side positioning of the hasp 62 from the top component 12 to allow the insertion of a portion of a lock through each of the hasps to securely close the lockable security box 10. As also described in this application and shown in FIGS. 3 and 7, the locking mechanism 60 may also consist of a self-contained lock similar to the types of locks used for bicycles, storage units or similar devices. In this form of the locking mechanism 60, a combination lock type feature engages a hasp member 62 that extends upwardly from the outer surface 34 of the bottom component 30 and engages a similar hasp member 62 extending downwardly from the front surface 26 of the top component 12. Also, as shown in the drawings, a handle type member H may extend from the front surface 26 of the top component 12 to provide the user with an element to grasp as the security box 10 is opened or closed. An example of a preferred form of the present invention, the bottom of the interior surface area of the bottom section 30 and top section 12 of the lockable security box 10 is approximately 60 square inches to securely accommodate phones, wallets, sunglasses etc. from the typical user. A preferred form of the lockable security box preferably has a general dimension of approximately 10.5 inches between side openings 14 and 16, by 6.5 inches between the top and bottom of the lockable security box 10 and by 5.5 inches between the front surface 38 and back surface 36 with an approximate size of 375 cubic inches.

Figure 6:
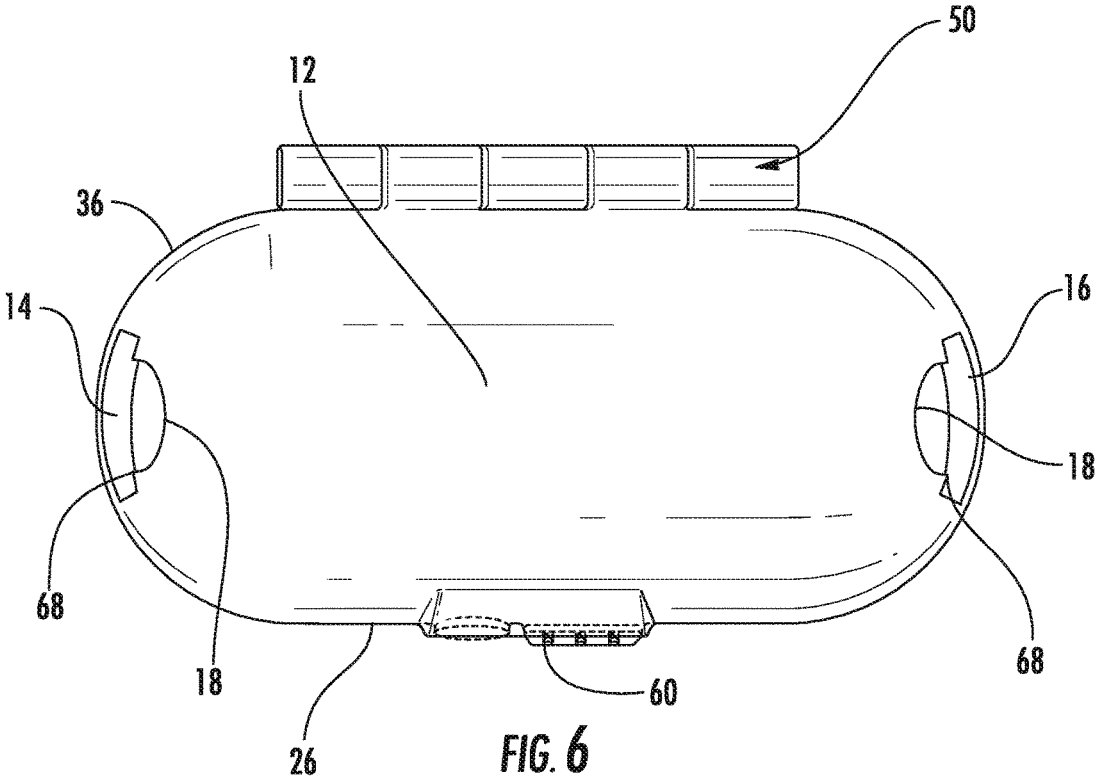
FIG. 6 shows a top view of both main components when assembled.
Figure 8:
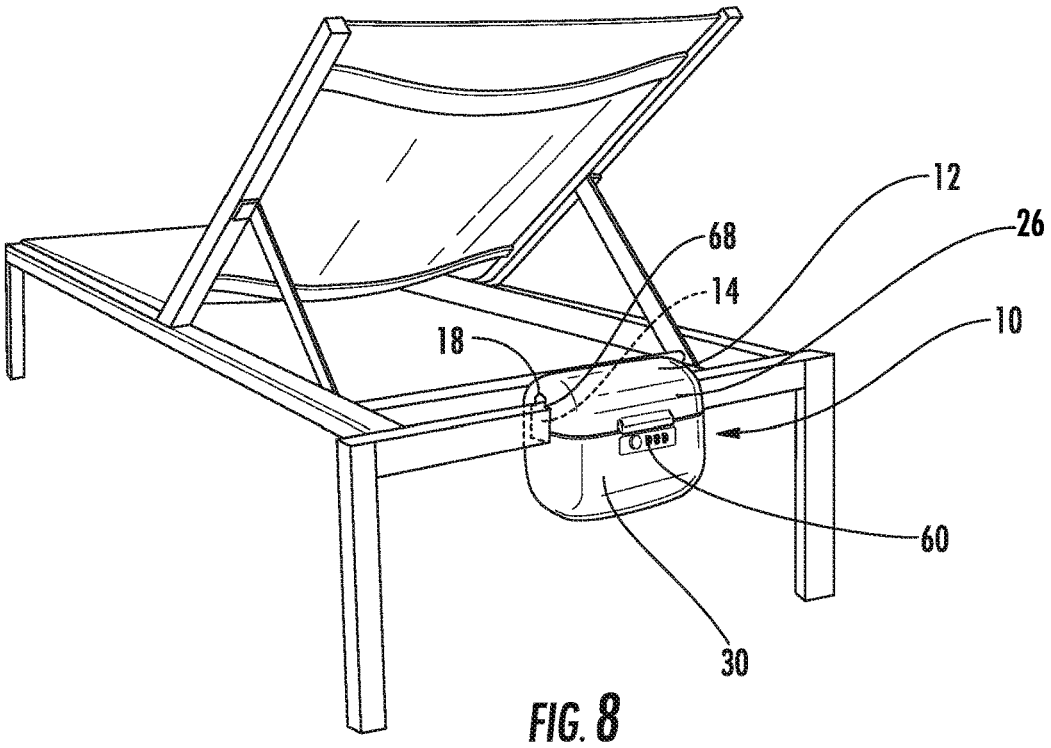
FIG. 8 is a perspective view of the present invention attached to the support bar of a lawn chair.
Figure 9:
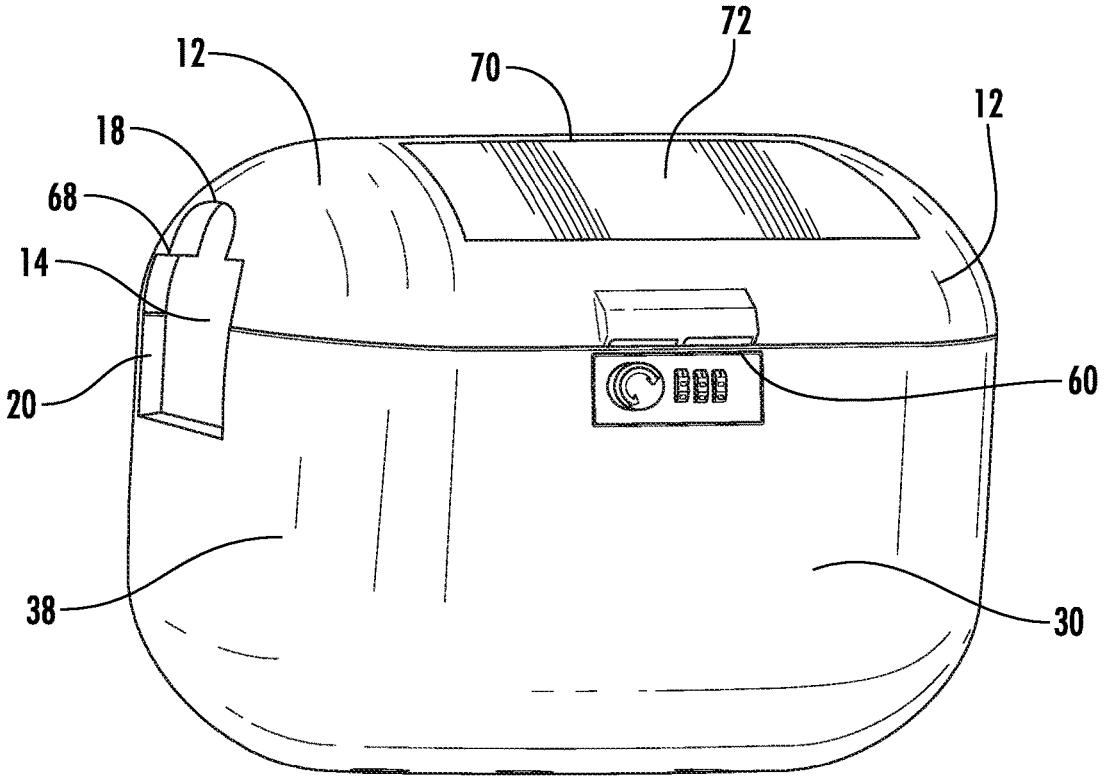
FIG. 9 shows a front view of both main components of an alternate embodiment when assembled.
Figure 10:
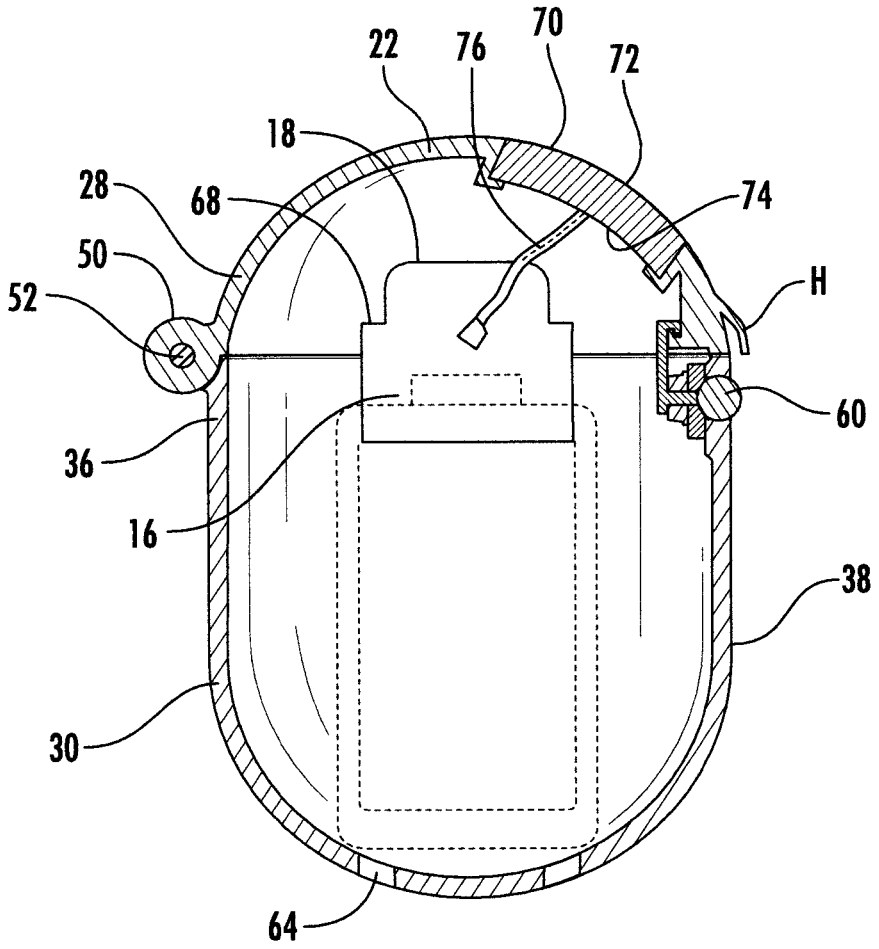
FIG. 10 shows a cross sectional view of a security box taken generally along the plane bisecting the embodiment of the invention shown in FIG. 9.
Figure 11:
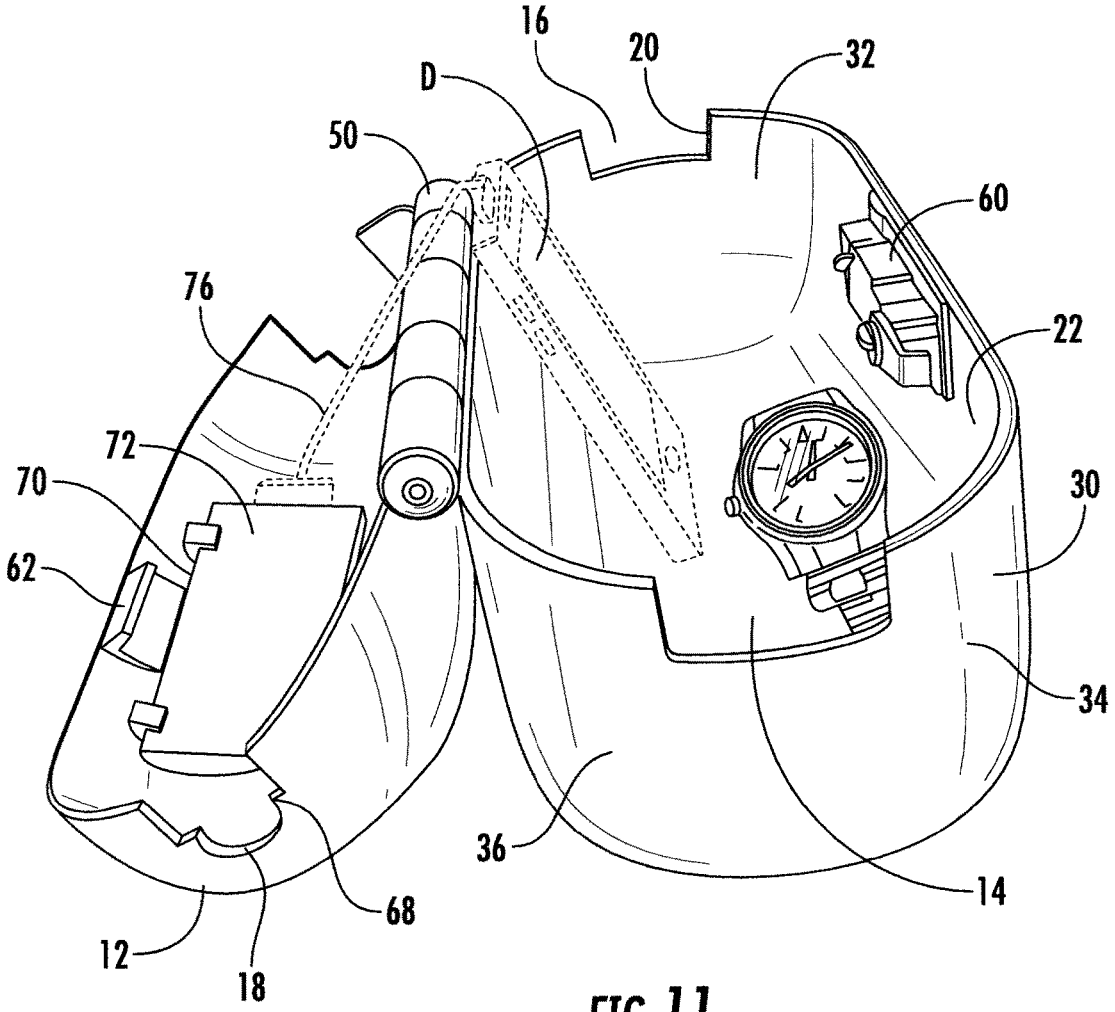
FIG. 11 shows an open view of both main components when assembled to demonstrate how the embodiment of FIG. 9 will be used to charge an electronic device.
Figure 12:
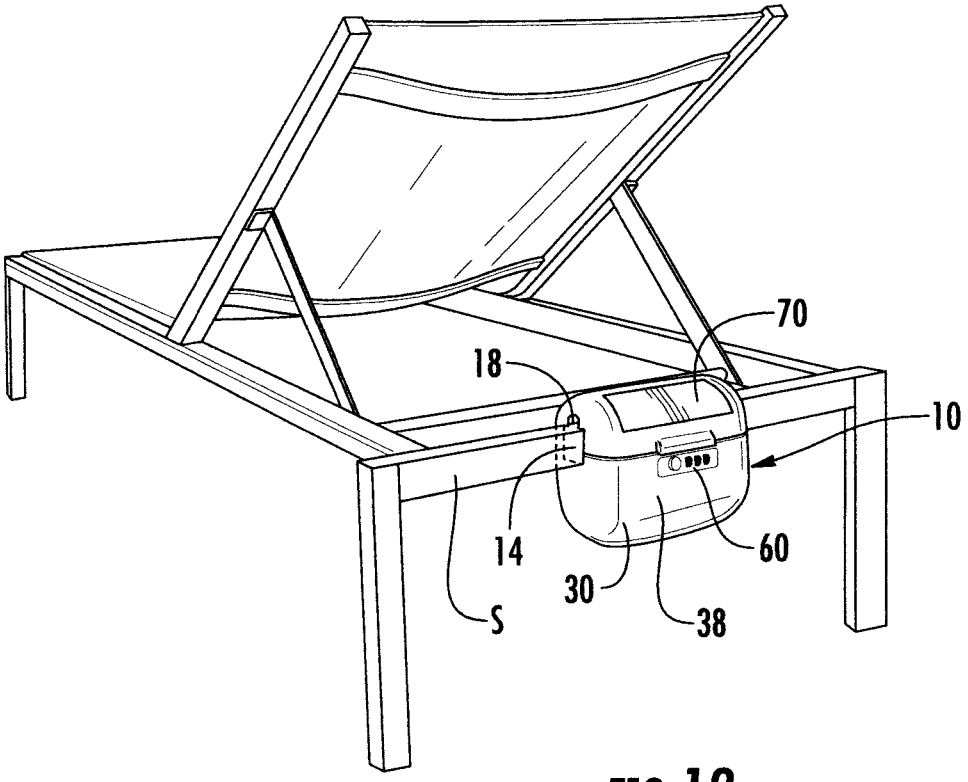
FIG. 12 is a perspective view of the invention shown in FIG. 9 attached to the support bar of a lawn chair.

FIGS. 6 and 8 are illustrative of the top and perspective views of a preferred form of the present invention. FIG. 8 shows the ability of support bar S running all the way through the invention through the side openings 14 and 16 to allow for the fixed object, such as the support bar, to center the gravitational pull of the bottom component 30 of the lockable security box 10 and its contents to the middle of the invention eliminating lopsidedness. As shown in the drawings, this feature is accomplished through the combination of the arcuate portion 18, corner lip 68 of the top component 12 and the generally straight sides and generally rectangular shape of the side openings 14 and 16 of the bottom component 30. Because the lockable security box 10 encloses around the support bar and the support bar has no free ends, the lockable security box 10 is retained on the desired structure until the present invention is opened by the user. Similarly, because the components of the lockable security box 10 are formed of a material that does not allow the contents of the box to be visible there through and the side openings of the box are shaped to minimize the ability to see into the box through the side openings, thus the contents are not readily viewable without opening the lockable security box.

As shown in FIGS. 9-12, an alternate embodiment of the present invention is provided with all of the features described above and further includes a solar panel 70 having the features described herein. The outer surface of the top component 12 preferably includes a solar panel 70 mounted thereon. As shown, the top charging surface 72 of the solar panel 70 is preferably flush along the outer surface of the top member and extends downwardly through the top component 12 to a position generally adjacent to the interior surface storage container. As further shown in FIGS. 10 and 11, the solar panel is preferably relatively flat or slightly curved to conform to the outer surface of the lockable container. The solar panel 70 has a generally rectangular shaped configuration with a top charging surface 72 and a bottom surface 74 that includes a charging cable 76 extending therefrom which is adapted to be connected to a device D to be charged. A plurality of ridges or tabs are shown to retain the solar panel in the top component 12 although adhesives or other methods of retaining the solar panel in the desired position may be used. The solar panel 70 is preferably embedded in the top component 12 to be fixedly retained in the top component and extends between the inner surface 22 and outer surface 24 of the top component 12. As shown, the charging surface 72 of the solar panel 70 is arranged to be positioned along the front and top surface of the top component 12 to maximize the exposure of the solar panel to the sun when the invention is attached to a lawn chair or is otherwise in its preferred orientation.

The solar panel 70 of the present invention is generally commercially available with little or no modification from a variety of commercial vendors. In a preferred form of the solar panel, the solar panel is preferably a monocrystalline solar panel with a capacity of about 12000 mAh and general dimensions between about 1 to 3 inches wide and about 5 to 7 inches in length with the exact dimensions depending on the efficiency, durability and a variety of other factors of the selected solar panel. The battery type is preferably a Lithium polymer battery with a lifetime charging capacity in excess of 800 times. One form of the solar panel has a full charging time of about 6 hours at 5.5V/1.7 W. The input of the solar panel when used as a phone charger is preferably 5V DC/IA with the output being preferably about 5V DC/2*1 A and includes a variety of internationally recognized certifications. The charging cord 76 is shown in the drawings and preferably includes a USB or mini USB connector to plug into the electronic device for charging.

Figure 13:
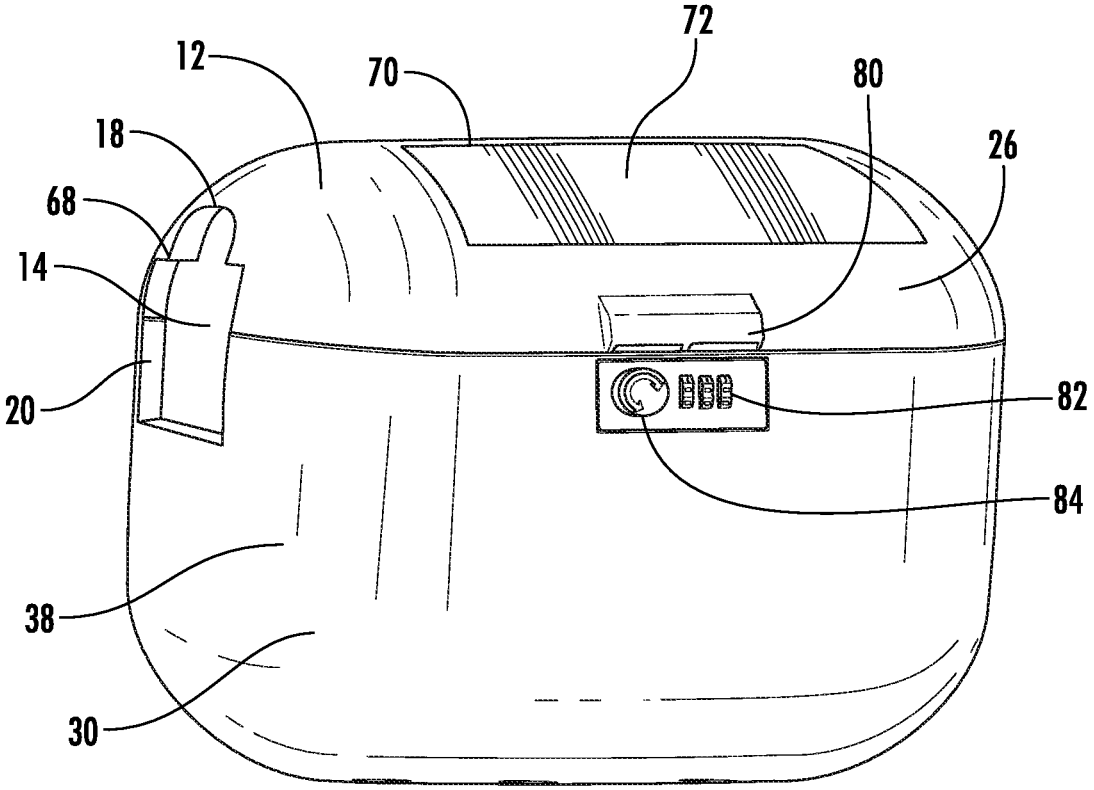
FIG. 13 shows an alternate embodiment of the present invention with a RFID locking mechanism for use with an activating wrist band to activate the RFID locking mechanism.

As shown in FIG. 13 an improved locking mechanism is disclosed that utilizes many of the components described in more detail above The front surface 26 of the top component 12 includes at least a portion of the locking mechanism 60 thereon and preferably consists of a combination lock type feature that extends or retracts to engage a hasp member 62 that is engaged in a recessed portion located along the inner surface 22 of the top component 12. As shown in FIGS. 1 and 13, the hasp member 62 extends along the front surface 38 of the bottom component 30 includes at least a portion of the locking mechanism 60 thereon. In the form of the locking mechanism 80 shown in FIG. 13, a RFID actuated lock includes a RFID powered switch 82 to movably cause the hasp member 62 that extends upwardly from the inner surface 32 of the bottom component 30 to engage in a recessed portion located along the inner surface 22 of the top component 12. The operation of the RFID locking mechanism is ideal for hotel or public pools where the use of the lockable container is on a rental or temporary basis to their patrons. In this embodiment, the RFID powered switch 82 responds to the presence of an RFID card or wrist band which, when properly recognized, allows the user to depress the switch button 84. When the switch button 84 is allowed to be depressed by the RFID switch, the hasp member 62 is movable from the recessed portion of the top component to allow the user to open the lockable container. If no RFID card or wrist band is detected in close proximity to the RFID powered switch, the user is unable to unlock the lockable container. The general function of this type of locking mechanism is best understood by analogy to a hotel room key where the card key activates a switch in the door which then allows the user to turn the door handle. In the present invention, the wristband or card activates the switch to allow the user to depress the button and unlock the lockable container.

In addition to the added convenience for the users of the lockable containers, the administration and trackability of the use of the lockable containers is greatly improved with the use of the RFID technology for the hotel managers or a rental group. As is standard with RFID technology, the use of the RFID cards or bracelets allow for the rapid reprogramming of the RFID powered switch 82 such that users may be added or deleted as needed and access to the contents of the lockable container may be monitored or controlled. Similarly, if there are issues with lost cards or bracelets, a manager may reprogram or open the lockable container for the guests.

The general standards for commonly used RFID technology allow for the opening of the lock in excess of 500,000 times. The battery life for common RFID switches allows the lock to be opened more than 10,000 times and even allows for an additional 150 openings after a low battery alarm is signaled. In a preferred form of this invention, the operating frequency may be in various bands within a frequency range of 125 KHz to 13.56 MHz and includes a sensing range of about 1 to 3 inches. In this embodiment, the user is allowed to place their wristband or card adjacent to the RFID switch 82 to activate the mechanism to allow the switch button 84 to be depressed thus opening the lock.

What is claimed is:

1. A simplified, portable, lockable container that is attachable to a fixed object to store valuables comprising:

an elongate top component having an inner surface and an arcuate outer surface, a bottom surface and front and back surface portions and a pair of spaced apart partial side openings and a lengthwise dimension extending between the partial side openings that is greater than the width dimension thereof extending between the front and back surface portions thereof;

an elongate bottom component having an inner surface, an outer surface, a top surface and front and back surface portions and a pair of spaced apart partial side openings and a lengthwise dimension extending between the partial side openings that is greater than the width dimension thereof extending between the front and back surface portions thereof and wherein the top component and bottom component are interconnected and movable with respect to each other along the elongate dimension by a hinge member;

a pair of spaced apart end openings formed by the partial side openings of the top and bottom components to form a support cavity that will fit a variety of different sized fixed objects extending therebetween;

a storage compartment formed by the inner surfaces of the top component and the bottom component that will enable the storage of valuables therein and wherein the top component and bottom component are secured together by a locking mechanism under which the fixed object is also engaged by the top component and bottom component and which will prevent unauthorized entry into the lockable container; and a solar panel affixed to the top component and wherein the solar panel includes a charging cable extending therefrom into the storage compartment.

2. The container of claim 1 wherein the solar panel is integrally mounted to the top component and includes a charging surface that is generally flush with at least a portion of the top component.

3. The container of claim 2 wherein the charging surface includes the charging cable that extends through the top component into the storage compartment.

4. The container of claim 1 wherein the solar panel is a generally elongate and rectangularly shaped member that extends along the lengthwise dimension of the top component.

5. The container of claim 1 wherein the solar panel is oriented along the top component closer to the locking mechanism than the hinge member.

6. The container of claim 1 wherein the locking mechanism includes a RFID switch that is activated by an external RFID member to allow the locking mechanism to release the top component and bottom components to enable the user to pivot the top component and bottom component away from each other along the hinge member.

7. The container of claim 6 wherein the RFID switch is actuatable to allow the user to engage a button to unlock the top component and bottom component in response to the detection of a RFID member.

8. A portable lockable security box comprising:

a top component having a lengthwise dimension that is greater than the width dimension thereof and an inner surface and an arcuate outer surface and front and back surface portions;

a bottom component having a lengthwise dimension that is greater than the width dimension thereof and inner and outer surfaces and front and back surface portions;

wherein said top component is movable with respect to the bottom component about a hinge member and is securely closed with a locking mechanism;

a pair of spaced apart side openings formed by said top component and bottom component;

wherein the combination of the top component and bottom components create a support cavity by placement of said side openings along the lengthwise dimension of the top and bottom components such that said support cavity can accommodate a variety of different sized elongate objects extending between the side openings and wherein the height of the top component is sufficient to hold an elongate object in the support cavity with sufficient structural integrity to support the weight of the lockable security box and the weight of objects capable of being stored in said lockable security box;

a solar panel affixed to the outer surface of the top component and said solar panel having a charging cable that extends from the solar panel into the support cavity; and a locking member having a RFID locking switch thereon.

9. The security box of claim 8 wherein the solar panel has a charging surface that is generally flush with the outer surface of the top component and the solar panel includes the charging cable that extends through the top component to a location adjacent to the support cavity.

10. The security box of claim 8 wherein the solar panel is a generally rectangular member that extends lengthwise along the part of the outer surface of the top component that is closer to the locking member than the hinge member.

11. The security box of claim 8 wherein the locking member includes a RFID switch that senses the proximity of a selected RFID element.

12. The security box of claim 11 wherein the RFID switch enables the movement of a component of the locking member when the proximity of a selected RFID element is detected to enable the user to unlock the security box.

13. The security box of claim 12 wherein actuation of the RFID switch enables to movement of a switch button which causes a hasp to separate from a recess in the locking member to allow the top component and bottom component to be movable with respect to each other to provide access to the support cavity and a storage area formed by the inner surfaces of the top component and bottom component.

14. A simplified, portable, lockable container that attaches to a fixed object to store valuables comprising:

an elongate top component having an inner surface and an arcuate outer surface and front and back surface portions and a lengthwise dimension that is greater than the width dimension thereof;

an elongate bottom component having an inner surface and an outer surface and front and back surface portions and a lengthwise dimension that is greater than the width dimension thereof and wherein the top component and bottom component are interconnected and movable with respect to each other along the elongate dimension of the top component and bottom component by a hinge member;

a pair of spaced apart side openings formed in the top and bottom components to form a support cavity that will fit a variety of different sized fixed objects extending therebetween;

a storage compartment formed by the inner surfaces of the top component and the bottom component for the storage of valuables therein and wherein the top component and bottom component are secured together by a locking member around which the fixed object is also engaged by the top component and bottom component and which will prevent unauthorized entry into the lockable container when the locking member is engaged; and wherein the locking member includes a RFID switch which is actuatable in response to the detection of a specific RFID signal in close proximity thereto and wherein when the RFID switch is actuated, the user may open the lockable container.

15. The container of claim 14 wherein the locking member includes a movable hasp located on one of the top and bottom components and a hasp retention recess which is located on the other of the top component and bottom component.

16. The container of claim 15 wherein the actuation of the RFID switch enables the user to engage a switch button which causes the hasp to be released from the recess to allow the user to open the lockable container to access the contents of the lockable container.

17. The container of claim 14 wherein the RFID switch is programmable to recognize one or more specific RFID signals.

18. The container of claim 17 wherein the RFID switch is programmable to recognize a master RFID signal and a changeable RFID signal.

19. The container of claim 14 further including a generally rectangularly shaped solar panel extending along at least a portion of the outer surface of the top component and wherein the solar panel includes a charging surface that is flush with the outer surface of the top component and a charging cable that extends into the storage component.

* * * * *